US006223160B1

(12) United States Patent
Kostka et al.

(10) Patent No.: US 6,223,160 B1
(45) **Date of Patent: *Apr. 24, 2001**

(54) APPARATUS AND METHOD FOR ACOUSTIC COMMAND INPUT TO AN ELEVATOR INSTALLATION

(75) Inventors: Miroslav Kostka, Ballwil; Paul Friedli, Remetschwil, both of (CH)

(73) Assignee: Inventio AG, Hergiswil (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/081,796

(22) Filed: May 20, 1998

(30) Foreign Application Priority Data

May 22, 1997 (EP) ..... 97810316

(51) Int. Cl.[7] ..... G10L 11/00
(52) U.S. Cl. ..... 704/275; 187/380
(58) Field of Search ..... 704/270, 275; 187/392, 389, 384, 381, 380

(56) References Cited

U.S. PATENT DOCUMENTS 4,590,604 * 5/1986 Feilchenfeld ..... 704/272
4,979,594 * 12/1990 Begle et al. ..... 187/380
5,255,341 10/1993 Nakajima .
5,602,963 * 2/1997 Bissonnette et al. ..... 704/275
5,689,094 11/1997 Friedli et al. .

FOREIGN PATENT DOCUMENTS

2156339 * 1/1996 (CA) ..... B66B/1/14
33 35 157 4/1985 (DE) .
0 699 617 3/1996 (EP) .

* cited by examiner

*Primary Examiner*—David Hudspeth
*Assistant Examiner*—Harold Zintel
(74) *Attorney, Agent, or Firm*—MacMillan, Sobanski & Todd, LLC

(57) ABSTRACT

A portable input apparatus permits an elevator destination call to be generated remotely from an associated elevator installation with respect to time and location. The input apparatus can be formed as, for example, a wristwatch having a user interface including a first display for visually indicating data, a first keyboard for the manual input of data or travel commands and an audio unit for the acoustic input of data or travel commands and for the generation of audio information to the elevator user. A destination floor identification, such as the English word "twenty-seven", can be an acoustic command destination call entered into the input apparatus and indicated on the first display as "27" whereby in the proximity of the elevator installation, the destination call is automatically communicated to an elevator control of the elevator installation. The elevator control then communicates to the portable input apparatus the identity of the elevator car that has been assigned to serve the call.

15 Claims, 3 Drawing Sheets

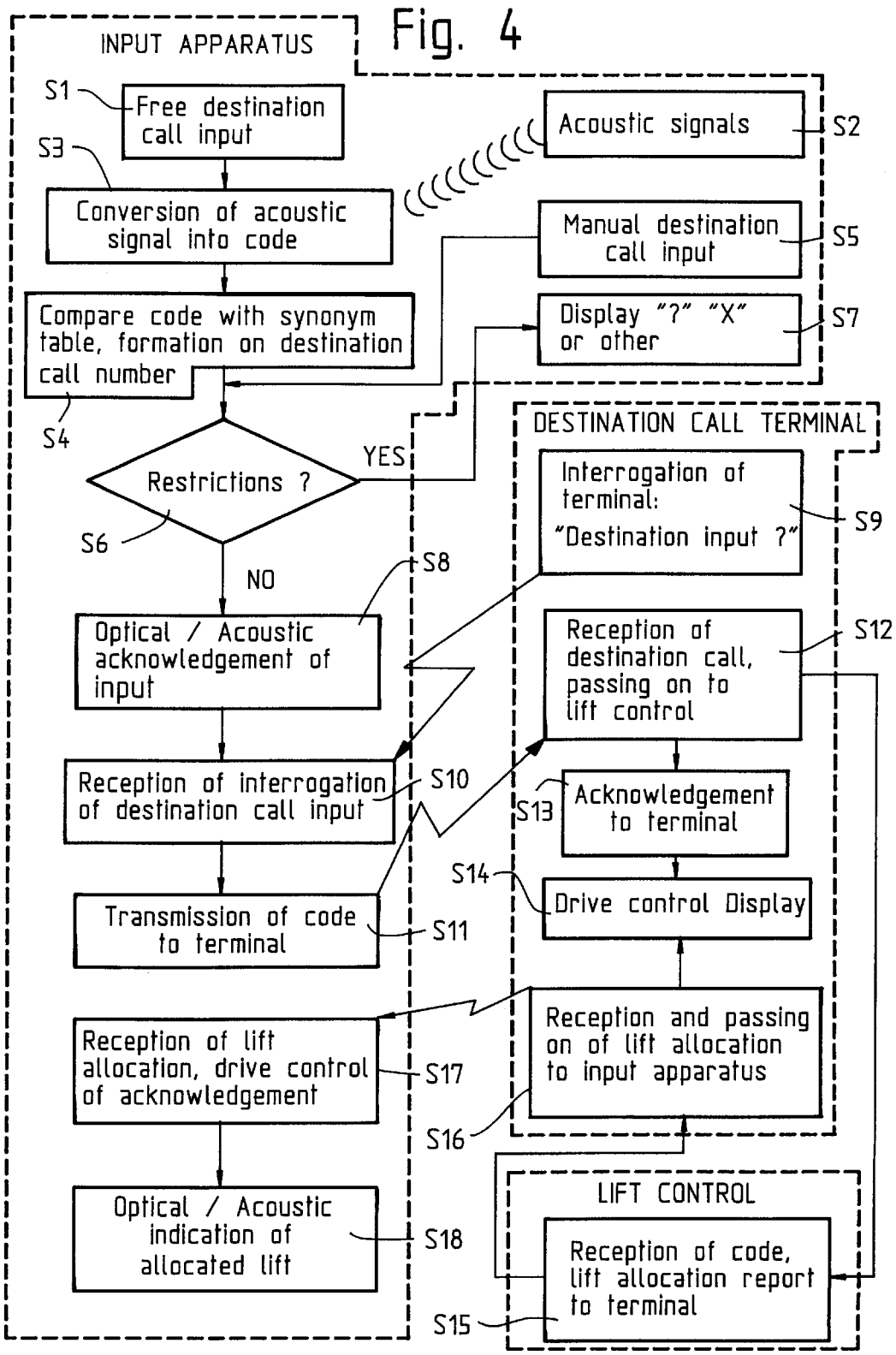
Fig. 4
INPUT APPARATUS
S1
Free destination call input
S3
Conversion of acoustic signal into code
Compare code with synonym table, formation on destination call number
S4
Restrictions ?
S6
YES
NO
Optical / Acoustic acknowledgement of input
S8
Reception of interrogation of destination call input
S10
Transmission of code to terminal
S11
Reception of lift allocation, drive control of acknowledgement
S17
Optical / Acoustic indication of allocated lift
S18
Acoustic signals
S2
Manual destination call input
S5
Display "?" "X" or other
S7
DESTINATION CALL TERMINAL
Interrogation of terminal: "Destination input ?"
S9
Reception of destination call, passing on to lift control
S12
Acknowledgement to terminal
S13
S14
Drive control Display
Reception and passing on of lift allocation to input apparatus
S16
LIFT CONTROL
Reception of code, lift allocation report to terminal
S15

APPARATUS AND METHOD FOR ACOUSTIC COMMAND INPUT TO AN ELEVATOR INSTALLATION

BACKGROUND OF THE INVENTION

The invention relates to an input apparatus and a method for acoustic command input to an elevator installation with an elevator control consisting of a unit for the reception and conversion of the acoustic commands and a display unit for the visualization of the acoustic command input.

There has become known from the U.S. Pat. No. 5,255,341, an elevator installation in which the travel commands to the floors can be input acoustically. A microphone and indicator lamps for the acoustically input travel commands are arranged in the proximity of the elevator entrance. So that speech recognition can be guaranteed, a distance sensor detects the presence of an elevator user within a specific distance from the microphone. The correct distance from the microphone is indicated to the elevator user by means of check lamps. The travel command acoustically communicated to the system by the elevator user is evaluated by a speech recognition unit and converted into an electrical signal corresponding to the desired floor and visualized at the indicator lamps. The travel commands can also be input manually by means of call buttons.

A disadvantage of the known equipment resides in the fact that the acoustic travel command input is possible only in the proximity of the elevator installation and only within a specific distance from the elevator entrance. The travel command input must be dealt with at just the place where the most interfering noise caused by the voices of the other elevator users arises. Erroneous evaluations of the speech recognition unit and thus an inadequate efficiency of the elevator installation are the consequence.

SUMMARY OF THE INVENTION

The present invention concerns a portable input apparatus that fulfills the objects of avoiding the disadvantages of the known equipment and of creating an apparatus that enables a separation in terms of time and place of a call input from the elevator installation.

The advantages achieved by the input apparatus according to the present invention are essentially that the elevator user can deal with the input of his travel destination in advance and remotely from the elevator installation. The elevator user can give his travel wish in a private environment and make it known to the elevator system in due course. He no longer needs to worry about having to input the call in front of a crowd in the hall or in the elevator car. It is further advantageous that the elevator installation can operate more efficiently, because it no longer has to wait for the manual input of travel commands claiming much time for input. It is furthermore advantageous that an individual checking of the elevator user is possible, because each elevator user has his personal input apparatus. Moreover, individual instructions, for example for the use of another elevator or an escalator, can be given to the owner of the portable input apparatus. Travel destinations can also be input in concepts synonymous to numbers. For example, the parking floor, which usually has to be selected by "−2", can be acoustically selected by the word "car". The input apparatus can also be equipped with further functions, such as, for example, telephone, pager or communication with the coffee machine. Furthermore, individual data of the user, such as, for example, speech, access authorization to specific floors, or restrictions, can be assigned to the apparatus.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 4 shows a flow chart for illustration of the communication between the input apparatus and the destination call terminal.

DESCRIPTION OF THE PREFERRED EMBODIMENT

Figure 1:
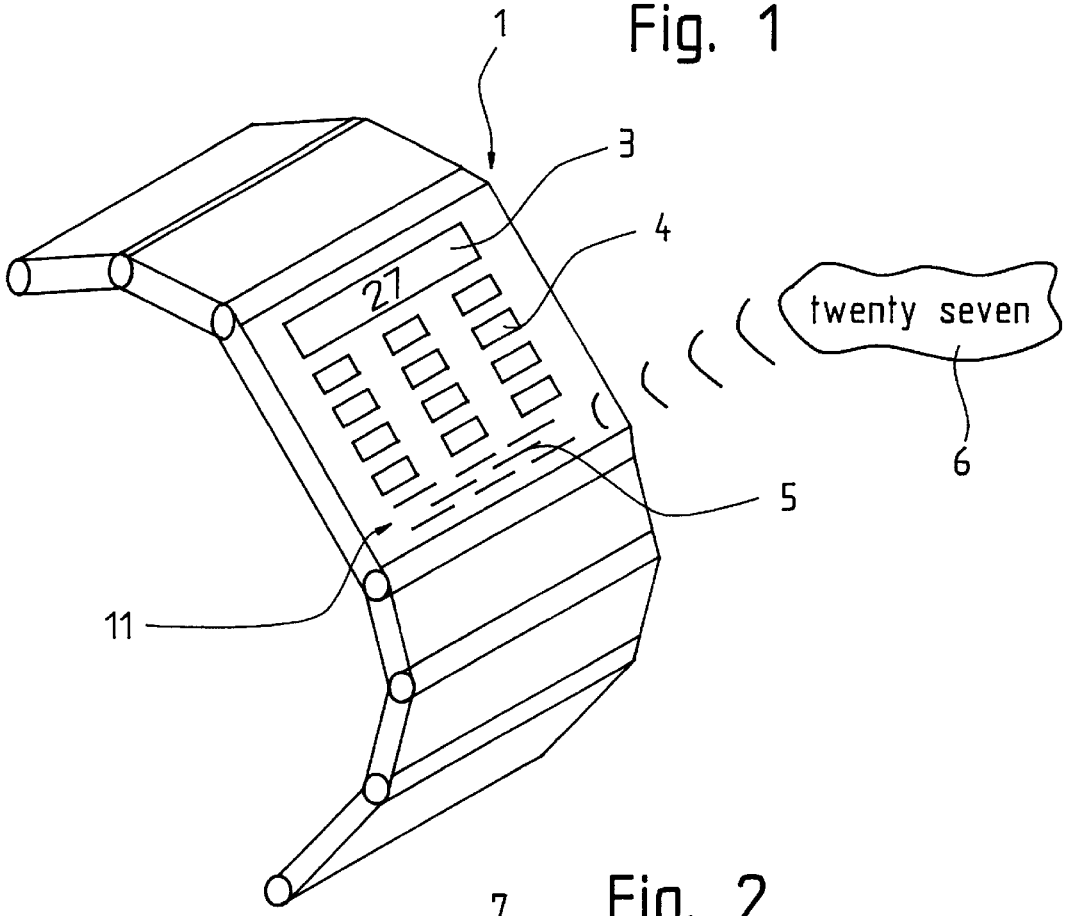
FIG. 1 shows a portable input apparatus according to the present invention for the acoustic input of destination calls to an elevator system.

A portable input apparatus 1 for inputting destination calls separated in terms of time and place from an associated elevator installation is shown in the FIGS. 1 to 4. The input apparatus 1 is illustrated in the form of a wristwatch. However, it can also have the form of other common objects, for example, of a credit card, a key fob or a signet ring. As an interface for a user 2 (a human hand and portion of an arm are shown in the FIG. 2), the input apparatus 1 includes a first display 3 for the visualization of data, a first keyboard 4 for manual input of data or travel commands, and an audio unit 5 for acoustic input of data or travel commands and for the generation of audio information. For example, a destination floor "twenty-seven" selected by English speech 6 is displayed on the display 3 as the number "27". A decade keyboard, on which the numbers of the selected floors are entered utilizing at least one numeral, can be used as the first keyboard 4. The keyboard 4 can also consist of individual keys each related to one of the floors.

Figure 2:
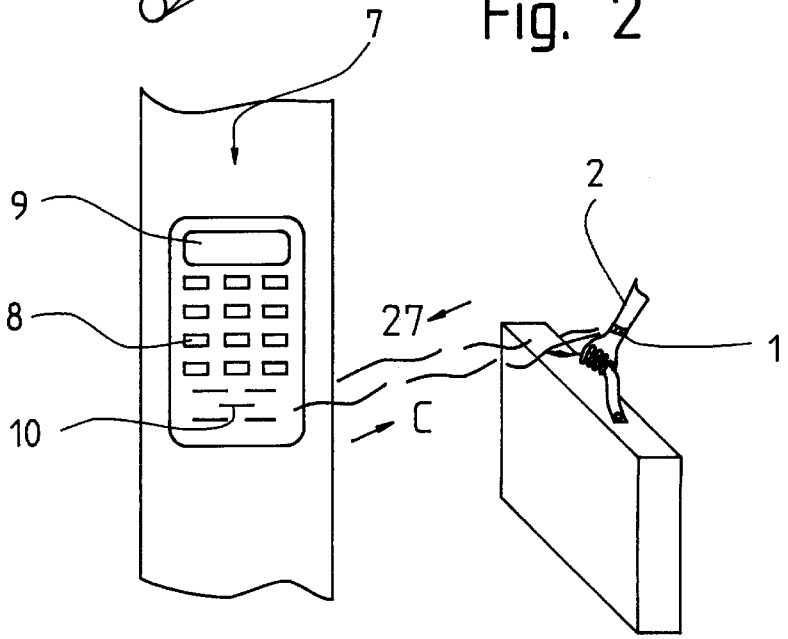
FIG. 2 shows a destination call terminal according to the present invention, which is arranged at a floor, for communication with the input apparatus shown in the FIG. 1.

The FIG. 2 shows a destination call terminal 7 that is located at a floor served by the elevator and at which destination calls are usually manually input by means of a second keyboard 8. The destination calls are immediately allocated by the destination call control to the elevator car with the best possible travel conditions, which car is visually identified for the user 2 on a second display 9 at the terminal 7. Moreover, the destination call terminal 7 includes a second transmitter/receiver unit 10, that can communicate with a first transmitter/receiver unit 11 of the portable input apparatus 1. In the FIG. 2, it is illustrated how the first transmitter/receiver unit 11 communicates, for example, the acoustically selected floor "27" information to the second transmitter/receiver unit 10. Thereafter, the identification of the elevator car "C", which car is allocated by the destination call control and executes the destination call, is indicated at the second display 9, communicated by means of the second transmitter/receiver unit 10 to the first transmitter/receiver unit 11, indicated at the first display 3 and made audible for the user 2 by the audio unit 5. The information is thus also available for the user 2 at any time outside the range of the designation call terminal 7. The user 2 can change, cancel or later input again his travel command at any time up to transmission to the destination call terminal 7. The energy source of the input apparatus 1 (typically a battery) or the designation call terminal 7 (typically building power) is not illustrated.

The input apparatus 1 can also communicate with a conventional elevator control, which has transmitter/receiver units, with floor pushbuttons and a car with a car control panel. In this case, the user 2 can send for and enter the elevator car and deal with the call input without having to go to the floor pushbutton or the car control panel. The car can depart earlier, because no time is lost for the call input.

Figure 3:
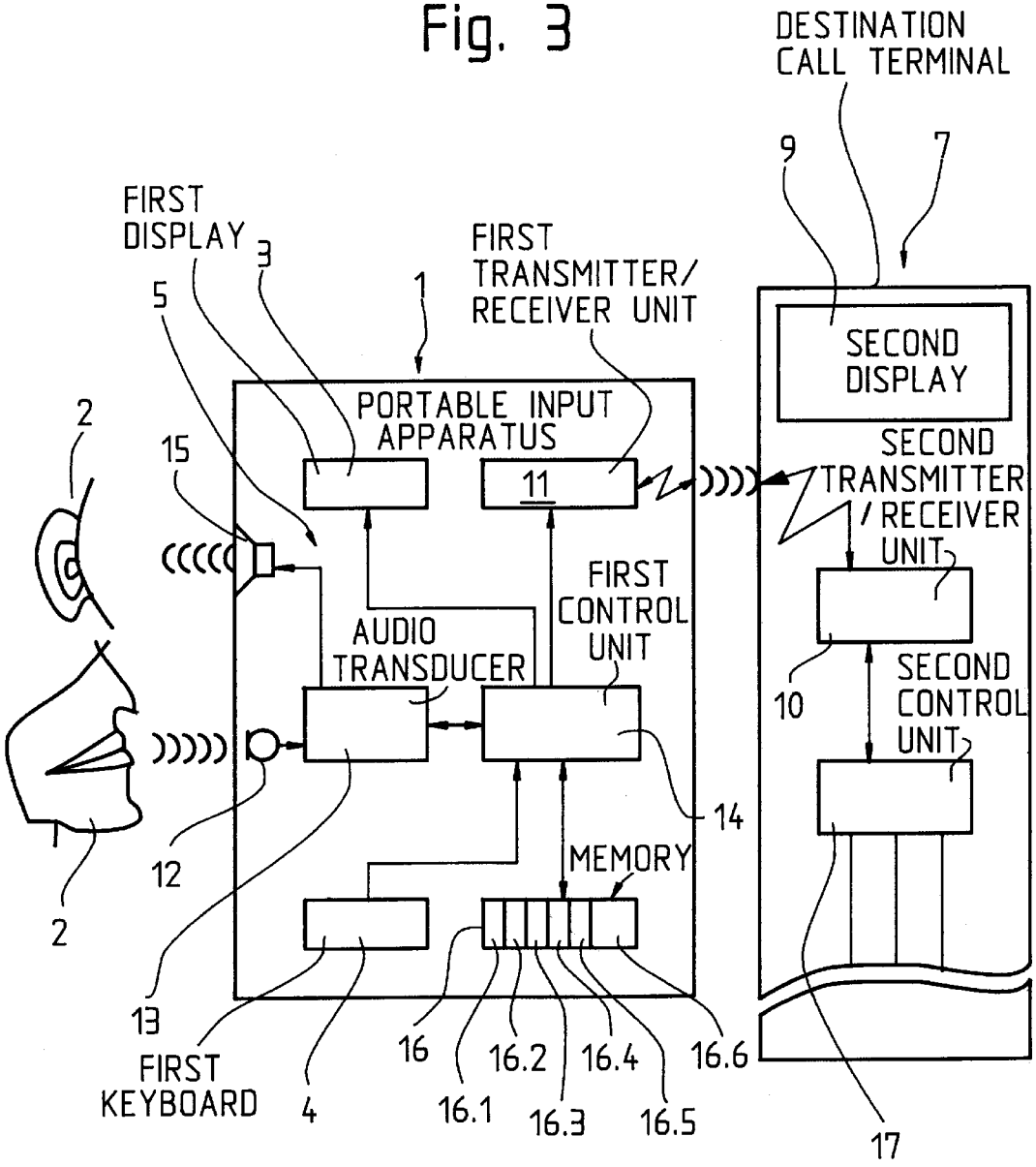
FIG. 3 shows a block circuit diagram of the input apparatus shown in the FIG. 1.

The FIG. 3 shows a block circuit diagram of the input apparatus 1. The user 2 passes on his travel command or destination call acoustically to a microphone 12, the output signal of which microphone is fed to an input of an audio transducer 13. In the speech recognition part of the audio transducer 13, the acoustic signal is converted into a digital signal, which digital signal is able to be further processed by a first control unit 14 equipped with a computer and having an input connected to an output of the transducer. In reverse direction, the digital signals of the first control unit 14 are fed from an output to an input of a speech synthesizing part of the audio transducer 13, that converts the digital signal into an analog audio signal. The audio signal is made audible for the user 2 by means of a loudspeaker 15 connected to an output of the transducer. The microphone 12, the loudspeaker 15 and the audio transducer 13 form the audio unit 5 of the input apparatus 1. The first control unit 14 is connected with the first display 3, the first keyboard 4, a memory 16 and the first transmitter/receiver unit 11. The control unit 14 controls the first display 3 and the interrogation of the first keyboard 4, compares input data with data in the memory 16, and passes on applicable data to the first receiver/transmitter 11. In reverse direction, data from the transmitter/receiver unit 11 is processed by the control unit 14. The memory 16 consists of several storage blocks for the storage of user data, system and operating data, safety data and statistical data. Individual data of the user, such as, for example, personal identification, preferred user service, preferred floor, speech, etc., are filed in a first storage block 16.1. Data of the operating elevator system, such as, for example, number of destination floors, transport speed, peak traffic times, number of elevator cars, zones, information about floor occupation, restaurants, etc., are filed in a second storage block 16.2. A synonym table is filed in a third storage block 16.3. As further explained above, the user 2 can select his destination floor by means of a number, for example, the number "27". However, the user also has the possibility of communicating his travel wish to the system in the form of a synonym which is simple to be aware of, such as, for example, "car', "coffee" or "restaurant". The control unit 14 has the capability, with the assistance of the synonym table filed in the third storage block 16.3, to convert the synonym into a floor number and/or inform the user 2 about the facilities located in the selected floor, such as, for example, opening and closing times of the parking deck, choice of beverages of the coffee machine or menu suggestions of the restaurant. Restriction data concerning entry and access controls are filed in a fourth storage block 16.4. Symbols or commands unable to be processed or floors barred to the user 2 are communicated to the user by means of the first display 3 or by means of the audio unit 5. Routines of the user 2 are filed in a fifth storage block 16.5. When, in accordance with usual practice, the user 2 inputs in his coffee break at 9 o'clock, this information is processed by the input apparatus 1 in a self-learning manner. After a certain time, due to the preceding routines, there is brought to the attention of the user 2, for example, the approaching coffee break. The desired travel destination is filed in a sixth storage block 16.6. The data of the memory 16 can be read and/or changed by the elevator operator by means of a programming apparatus or on the approach to the transmitter/receiver units 10 and 11, or by means of a code directly via the keyboard 4 and/or by means of acoustic inputs via the audio unit 5.

As soon as the user 2 comes into the immediate vicinity of the elevator installation, by his input apparatus 1 the second transmitter/receiver unit 10 begins communication with the first transmitter/receiver unit 11. This communication transmits the travel command to the destination story terminal 7. As soon as the travel command is allocated, the identification of the elevator car "C" executing the travel command is acoustically and optically communicated to the user 2 by means of the input apparatus 1. The second transmitter/receiver unit 10 is connected with a second control unit 17, which control unit is equipped with a computer, of the destination call terminal 7, which computer handles the data traffic with the elevator control.

The FIG. 4 shows a flow chart for the illustration of the communication between the input apparatus 1 and the destination call terminal 7. In a step S1, the input apparatus 1 is, after an initializing, freed for destination call input. The user 2 now has the possibility of inputting a travel command acoustically in a step S2 or manually in a step S5 by means of the input apparatus 1. In the case of acoustic destination call input, the acoustic signal, for example the floor number "twenty-seven", is converted by means of the audio transducer 13 into a machine-readable signal or code in a step S3. In a step S4, the first control unit 14 forms, if necessary also with the assistance of the synonym table, the destination call number corresponding to the desired floor. It is checked in a step S6 whether the desired destination call is subject to restrictions. By an output, which is designated by "YES", of the checking step, the user 2 is, as shown in a step S7, acoustically and/or optically notified that the desired destination call input is not able to be performed. By an output, which is designated by "NO", of the checking step S6, the desired destination floor is, as shown in a step S8, optically and acoustically acknowledged at the input apparatus 1 and filed in the sixth storage block 16.6. The destination call input is thus completed. However, the input can be corrected or input again at any time up to communication to the destination call terminal 7. In the vicinity of the elevator installation, the second transmitter/receiver unit 11 of the destination call terminal 7 requires, as shown in a step S9 and a step S10, the input apparatus 1 to communicate the call input. In a step S11, the travel destination desired by the user 2 is transmitted to the destination call terminal 7, which passes on the destination call to the elevator control in a step S12 and visually displays it at the second display 9 in a step S13 and a step S14. In a step S15, the elevator control immediately allocates the destination call to the elevator car with the best travel conditions having regard to the number of passengers and the total travel distance. The identification of the allocated elevator car "C" executing the destination call is transmitted to the destination call terminal 7. The communication of the allocated elevator car "C" to the input apparatus 1 by means of the transmitter/receiver units 10 and 11 takes place in a step S16 and a step S17. The communication between the input apparatus 1 and the destination call terminal 7 takes place in wire-free manner, for example, in the infrared range. The identification of the allocated elevator car "C" is optically and/or acoustically communicated to the user 2 in a step S18. The optical indication remains until the user has entered the elevator car "C".

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for inputting an elevator command to an elevator installation having an elevator control comprising:

a portable input means for receiving, storing and transmitting data in a plurality of acoustic elevator commands;

an audio unit included in said input means for reception and conversion of each of said acoustic elevator commands to related elevator command data;

a transmitter/receiver unit in said input means for non-acoustic communication of said elevator command data; and a control unit included in said input means and connected to said audio unit and said transmitter/receiver unit for controlling inputting of said acoustic elevator commands when said input means is located remote from an associated elevator installation and storing the related elevator command data for later non-acoustic communication to an elevator control of the associated elevator installation when said input means is proximate the elevator control, said control unit being responsive to an interrogation communication received by said transmitter/receiver unit for generating said non-acoustic communication to the elevator control.

2. The apparatus according to claim 1 wherein said portable input means includes a display unit for visually indicating said elevator command data.

3. The apparatus according to claim 2 wherein said portable input means includes a keyboard connected to said control unit for input of additional data representing at least one of individual user data, elevator operating data, elevator system data and elevator travel destination data, said display unit visually indicating said additional data.

4. The apparatus according to claim 2 wherein said portable input means includes a memory connected to said control unit for storage of said elevator command data and said additional data.

5. The apparatus according to claim 4 wherein said memory includes a first storage block for storing said individual user data, a second storage block for storing said elevator operating and system data, a third storage block for storing a synonym table, a fourth storage block for storing restriction data for elevator use, a fifth storage block for storing routines of a user and a sixth storage block for storing a desired travel destination represented by said elevator command data.

6. The apparatus according to claim 1 wherein said transmitter/receiver unit in said input means is a first transmitter/receiver unit that communicates said elevator command data to a second transmitter/receiver unit at a call terminal of the associated elevator installation.

7. The apparatus according to claim 6 wherein said first transmitter/receiver unit communicates with the second transmitter/receiver unit by infrared signals.

8. The apparatus according to claim 6 wherein said first transmitter/receiver unit communicates said elevator command data in response to receiving said interrogation communication from the second transmitter/receiver unit.

9. The apparatus according to claim 1 wherein said audio unit includes a microphone for reception of said acoustic elevator commands, a loudspeaker for generating audio information and an audio transducer connected to said microphone and to said loudspeaker for speech recognition in response to said acoustic elevator commands and speech synthesis to generate said audio information.

10. A system for inputting an elevator command to an elevator installation comprising:

an elevator control for controlling an elevator installation;

a portable input means for receiving, storing and transmitting data in a plurality of acoustic elevator commands for said elevator control;

an audio unit included in said input means for reception and conversion of each of said acoustic elevator commands to related elevator command data;

a first transmitter/receiver unit in said input means for non-acoustic communication of said elevator command data to said elevator control; and a first control unit included in said input means and connected to said audio unit and said first transmitter/receiver unit for controlling inputting of said acoustic elevator commands when said input means is located remote from said elevator control and storing the related elevator command data for later non-acoustic communication to said elevator control when said input means is within communication range of said elevator control said control unit being responsive to an interrogation communication received by said transmitter/receiver unit for generating said non-acoustic communication to the elevator control.

11. The system according to claim 10 wherein said elevator control includes a second transmitter/receiver unit and said first transmitter/receiver unit communicates said elevator command data to said second transmitter/receiver unit in response to receiving said interrogation communication from said second transmitter/receiver unit.

12. The system according to claim 11 wherein said first transmitter/receiver unit and said second transmitter/receiver unit communicate by infrared signals.

13. A method for remotely inputting an elevator command to an elevator installation having an elevator control comprising the steps of:

a. receiving an acoustic elevator command at a location remote from an associated elevator control of an elevator installation;

b. storing the acoustic elevator command in a portable input means for later non-acoustic communication to the elevator control; and c. automatically communicating the stored acoustic elevator command to the elevator control by wireless non-acoustic communication when the portable input means is within communication range of the elevator control and in response to receiving an interrogation communication.

14. The method according to claim 13 including indicating to a user of the elevator installation by at least one of acoustically and optically an elevator assigned in response to the acoustic elevator command.

15. The method according to claim 13 wherein the acoustic elevator command is a destination floor number.

* * * * *